US011731144B2

(12) United States Patent
Kühnert et al.

(10) Patent No.: US 11,731,144 B2
(45) Date of Patent: Aug. 22, 2023

(54) CENTRIFUGE ROTOR WITH LOCKING LEVERS PROVIDING VISUAL INDICATION OF COVER CLOSURE

(71) Applicant: Eppendorf AG, Hamburg (DE)

(72) Inventors: Steffen Kühnert, Leipzig (DE); Christoph Knospe, Hamburg (DE)

(73) Assignee: Eppendorf SE, Hamburg (DE)

( * ) Notice: Subject to any disclaimer, the term of this patent is extended or adjusted under 35 U.S.C. 154(b) by 400 days.

(21) Appl. No.: 16/955,422

(22) PCT Filed: Dec. 12, 2018

(86) PCT No.: PCT/EP2018/084504

§ 371 (c)(1),
(2) Date: Jun. 18, 2020

(87) PCT Pub. No.: WO2019/121214

PCT Pub. Date: Jun. 27, 2019

(65) Prior Publication Data

US 2020/0406271 A1 Dec. 31, 2020

(30) Foreign Application Priority Data

Dec. 20, 2017 (DE) ..... 10 2017 130 787.7

(51) Int. Cl.
*B04B 7/02* (2006.01)
*B04B 5/04* (2006.01)
(Continued)

(52) U.S. Cl.
CPC ..... *B04B 7/02* (2013.01); *B04B 5/0414* (2013.01); *B04B 7/08* (2013.01); *B04B 2007/025* (2013.01); *B04B 2009/085* (2013.01)

(58) Field of Classification Search
CPC ..... B04B 7/02; B04B 5/0414; B04B 7/08; B04B 2007/025; B04B 5/04; B04B 9/00; B04B 2009/085
(Continued)

(56) References Cited

U.S. PATENT DOCUMENTS 2,329,499 A * 9/1943 Weaver ..... D01D 7/02 57/77
2,827,229 A * 3/1958 Blum ..... B04B 5/0414 494/84
(Continued)

FOREIGN PATENT DOCUMENTS

CN 1459336 A 12/2003
CN 1840237 A 10/2006
(Continued)

OTHER PUBLICATIONS

National Intellectual Property Administration of the People's Republic of China, Office Action in related Chinese patent application 201880085373.X, English Translation, dated Sep. 7, 2021.

*Primary Examiner* — Charles Cooley
(74) *Attorney, Agent, or Firm* — Smartpat PLC

(57) ABSTRACT

A centrifuge rotor (10) includes a closure (32) between a lower part (12) of the centrifuge rotor (10) and a cover (14). The centrifuge rotor has been improved such that proper single-handed operation is made possible. In particular, the closure (32) can be closed and detached again using just one hand. The cover (14) includes a circular cut-out (20) for fastening the centrifuge rotor (10) in a centrifuge. The cover (14) is attached to the lower part (12) by levers having a concave shaping (66). The cover (14) and the levers cooperate to provide a visual indication whether the cover is properly closed.

14 Claims, 8 Drawing Sheets

(51) Int. Cl.
*B04B 7/08* (2006.01)
*B04B 9/08* (2006.01)

(58) Field of Classification Search
USPC ..... 494/12, 16
See application file for complete search history.

(56) References Cited

U.S. PATENT DOCUMENTS 2,865,662 A * 12/1958 Nurmse ..... A01K 89/0111 411/530
3,028,075 A * 4/1962 Blum ..... B04B 5/0421 494/20
3,779,451 A * 12/1973 Lehman ..... B04B 9/12 494/84
3,819,111 A * 6/1974 Romanauskas ..... B04B 5/0414 494/38
3,843,045 A * 10/1974 Schmidt ..... B04B 7/08 494/79
3,961,745 A * 6/1976 Wright ..... B04B 7/06 416/207
4,010,890 A * 3/1977 Wright ..... B04B 7/02 494/20
4,193,538 A * 3/1980 Schwarz ..... B04B 5/0414 494/10
4,344,563 A * 8/1982 Romanauskas ..... B04B 5/0421 494/20
4,360,151 A * 11/1982 Cowell ..... B04B 5/0414 494/12
4,412,830 A * 11/1983 Strain ..... B04B 7/02 494/12
4,435,169 A * 3/1984 Romanauskas ..... B04B 7/02 494/20
4,753,631 A * 6/1988 Romanauskas ..... B04B 9/08 494/9
4,822,331 A * 4/1989 Taylor ..... B04B 5/0414 494/84
4,850,951 A * 7/1989 Cheng ..... B04B 5/0414 494/16
5,071,402 A * 12/1991 Weyant, Jr. ..... B04B 5/0414 494/16
5,342,282 A * 8/1994 Letourneur ..... F16C 33/7886 384/480
5,344,380 A * 9/1994 Chern ..... B04B 7/02 411/383
5,411,465 A * 5/1995 Glen ..... B04B 5/0414 494/81
5,443,438 A * 8/1995 Wright ..... F16D 1/101 494/84
5,456,653 A * 10/1995 Wright ..... F16D 3/12 494/84
5,512,030 A * 4/1996 Barkus ..... B04B 7/08 494/16
5,558,616 A * 9/1996 Barkus ..... B04B 7/02 494/12
5,681,257 A * 10/1997 Letourneur ..... B04B 9/08 494/12
5,897,482 A * 4/1999 Lowe ..... B04B 7/02 494/12
6,024,687 A * 2/2000 Cheng ..... F16D 43/18 494/84
6,056,684 A * 5/2000 Linder ..... B04B 7/02 494/12
6,063,018 A * 5/2000 Letourneur ..... B04B 9/08 494/12
6,149,570 A * 11/2000 Lowe ..... B04B 7/02 494/12
6,149,571 A * 11/2000 Okada ..... B04B 9/12 494/20
6,183,408 B1 * 2/2001 Wright ..... F16C 17/20 494/83
6,286,838 B1 * 9/2001 Kruger ..... B04B 7/02 73/1.87
6,461,287 B1 * 10/2002 Glater ..... B01L 9/523 494/83
6,665,924 B2 * 12/2003 Schutz ..... B04B 9/08 494/12
6,764,438 B2 * 7/2004 Potter ..... F16D 43/16 494/12
6,776,751 B2 * 8/2004 Potter ..... B04B 9/08 494/12
6,802,803 B2 * 10/2004 Potter ..... B04B 5/0414 494/12
6,840,705 B2 * 1/2005 Rager ..... F16B 7/105 403/379.2
6,981,304 B2 * 1/2006 Potter ..... B04B 9/08 29/428
7,011,618 B2 * 3/2006 Potter ..... B04B 9/08 494/12
7,081,081 B2 * 7/2006 Schutz ..... B04B 9/08 494/12
7,137,198 B2 * 11/2006 Potter ..... B04B 7/02 29/889
7,311,652 B2 * 12/2007 Henne ..... B04B 5/0414 494/12
7,419,464 B2 * 9/2008 Matusima ..... F16D 1/06 403/322.2
7,464,450 B2 * 12/2008 Potter ..... B04B 9/08 29/434
7,837,607 B2 * 11/2010 Woodman ..... F16D 1/112 494/20
8,678,987 B2 * 3/2014 Henne ..... B04B 9/08 494/12
8,852,070 B2 * 10/2014 Peters ..... B04B 9/08 494/12
9,079,195 B2 * 7/2015 Todteberg ..... B04B 7/08
9,149,815 B2 * 10/2015 Köhn ..... B04B 7/08
9,339,824 B2 * 5/2016 Henne ..... B04B 9/08
9,452,436 B2 * 9/2016 Ballhause ..... B04B 9/08
9,539,588 B2 * 1/2017 Le Guyader ..... B04B 9/08
9,718,067 B2 * 8/2017 Ballhause ..... F16D 1/116
9,782,783 B2 * 10/2017 Bittner ..... F16D 43/16
2003/0144124 A1 * 7/2003 Schutz ..... B04B 5/0414 494/12
2003/0196310 A1 * 10/2003 Potter ..... B04B 9/08 29/428
2003/0199380 A1 * 10/2003 Potter ..... F16D 43/16 494/12
2003/0199381 A1 * 10/2003 Potter ..... F16D 43/16 494/12
2003/0216238 A1 11/2003 Yamada et al.
2004/0018928 A1 * 1/2004 Schutz ..... B04B 9/08 494/12
2004/0220037 A1 * 11/2004 Potter ..... B04B 9/08 494/12
2004/0224831 A1 * 11/2004 Potter ..... B04B 5/0414 494/12
2004/0229742 A1 * 11/2004 Potter ..... B04B 9/08 494/12
2005/0221971 A1 * 10/2005 Potter ..... B04B 9/08 494/84
2006/0058169 A1 * 3/2006 Matusima ..... F16D 1/112 494/84
2006/0240963 A1 * 10/2006 Henne ..... B04B 5/0414 494/38
2008/0146429 A1 * 6/2008 Woodman ..... F16D 1/06 494/12
2010/0160138 A1 * 6/2010 Henne ..... F16F 15/04 494/83
2011/0183830 A1 7/2011 Tietze et al.
2011/0212819 A1 * 9/2011 Kohn ..... B04B 7/08 494/60
2011/0212822 A1 * 9/2011 Henne ..... B04B 9/08 494/84
2013/0188894 A1 * 7/2013 Peters ..... F16C 35/00 384/91
2013/0203581 A1 * 8/2013 Le Guyader ..... F16D 1/116 494/10

(56) References Cited

U.S. PATENT DOCUMENTS

2013/0237399 A1* 9/2013 Letourneur ..... B04B 9/00 494/10
2013/0331253 A1* 12/2013 Ballhause ..... B04B 9/00 494/84
2014/0329658 A1* 11/2014 Le Guyader ..... B04B 9/08 494/82
2014/0349829 A1* 11/2014 Todteberg ..... B04B 5/0414 494/60
2015/0231648 A1* 8/2015 Henne ..... B04B 9/00 494/84
2015/0343459 A1* 12/2015 Ballhause ..... B04B 9/08 494/84
2016/0107171 A1* 4/2016 Bittner ..... F16D 1/116 494/84
2016/0158769 A1* 6/2016 Hornek ..... B04B 9/08 494/83
2017/0050194 A1* 2/2017 Hornek ..... B04B 7/02
2017/0050195 A1* 2/2017 Hornek ..... B04B 9/08
2017/0252754 A1* 9/2017 Hoelderle ..... F16D 1/108
2018/0318847 A1* 11/2018 Lüersmann ..... B04B 1/08
2020/0055060 A1* 2/2020 Kühnert ..... B04B 7/08
2020/0406270 A1* 12/2020 Kühnert ..... F16B 21/18
2020/0406271 A1* 12/2020 Kühnert ..... B04B 5/0414
2021/0187518 A1* 6/2021 Kühnert ..... B04B 5/0414
2022/0040709 A1* 2/2022 Kühnert ..... B04B 9/08
2022/0072566 A1* 3/2022 Kühnert ..... B04B 9/08

FOREIGN PATENT DOCUMENTS

| | | | | |
|---|---|---|---|---|
| CN | 102123795 | A | | 7/2011 |
| CN | 103180049 | A | | 6/2013 |
| CN | 106795784 | A | | 5/2017 |
| CN | 106856657 | A | | 6/2017 |
| CN | 106902995 | A | | 6/2017 |
| DE | 102005014218 | A1 | | 10/2006 |
| DE | 102011107667 | A1 | | 1/2013 |
| DE | 102015113855 | A1 | | 2/2017 |
| EP | 3132855 | B1 | | 4/2018 |
| JP | H05345149 | A | | 12/1993 |
| JP | 2005526604 | A | | 9/2005 |
| JP | 2006272330 | A | | 10/2006 |
| TW | 459558 | U | | 10/2001 |
| WO | 83/04379 | | * | 12/1983 |
| WO | 2007134624 | A1 | | 11/2007 |
| WO | 2011/001729 | A1 | * | 1/2011 |

* cited by examiner

CENTRIFUGE ROTOR WITH LOCKING LEVERS PROVIDING VISUAL INDICATION OF COVER CLOSURE

TECHNICAL FIELD

The present invention relates to a centrifuge rotor.

BACKGROUND

Centrifuge rotors are used in centrifuges, in particular laboratory centrifuges, to separate the constituents of samples centrifuged therein using the inertia. In this process, ever greater rotational speeds are used to achieve high segregation rates. In this case, laboratory centrifuges are centrifuges of which the rotors operate at preferably at least 3,000, preferably at least 10,000, in particular at least 15,000 revolutions per minute and are usually placed on workbenches. In order to be able to place said centrifuges on a workbench, they in particular have a form factor of less than 1 m×1 m×1 m, i.e. its installation space is limited. Preferably, the appliance depth is limited to max. 70 cm here.

It is usually provided that the samples are centrifuged at certain temperatures. For example, samples that contain proteins and organic substances of this kind must not be overheated, and therefore the upper limit for the temperature control of such samples is in the range of +40° C. as standard. In addition, certain samples are cooled in the range of +4° C. as standard (the anomaly of the water begins at 3.98° C.).

In addition to such predetermined maximum temperatures of, for example, approx. +40° C. and standard analysis temperatures such as +4° C., further standard analysis temperatures are provided, such as +11° C., in order to test whether, at this temperature, the cooling system of the centrifuge runs in a regulated manner below room temperature. In addition, for reasons of occupational safety, it is necessary to prevent elements that have a temperature of greater than or equal to +60° C. from being touched.

As a rule, active and passive systems can be used for the temperature control. Active cooling systems have a coolant circuit which controls the temperature of the centrifuge bowl, as a result of which the centrifuge rotor and the sample container received therein are indirectly cooled.

Passive systems are based on exhaust-air-assisted cooling or ventilation. This air is guided directly past the centrifuge rotor, resulting in temperature control. In this process, the air is suctioned through openings in the centrifuge bowl, wherein the suctioning takes place independently due to the rotation of the centrifuge rotor.

The samples to be centrifuged are stored in sample containers and these sample containers are rotationally driven by means of a centrifuge rotor. In this process, the centrifuge rotors are usually set in rotation by means of a vertical drive shaft which is driven by an electric motor. There are various centrifuge rotors which can be used depending on the intended use. Here, the sample containers can contain the samples directly or separate sample receptacles which contain the sample are inserted in the sample containers such that a plurality of samples can be centrifuged at the same time in one sample container.

Broadly speaking, such centrifuge rotors usually comprise a lower part and a cover, wherein, when the cover is closed, an interior space is formed between the lower part and the cover, in which interior space the sample vessels can be arranged in order to centrifuge the samples in a suitable centrifuge. When the sample vessels are arranged at a fixed angle in the centrifuge rotor, this is what is known as a fixed angle rotor.

For connection to the centrifuge, the lower part is usually provided with a hub, which can be coupled to the drive shaft of the centrifuge, which is driven by the motor. The cover in turn is designed such that it can normally be closed against the lower part.

Usually, there is aerosol-tight sealing between the cover and the lower part, wherein, for example, the fixed angle rotor FA-45-48-11 from Eppendorf®, which can, for example, be used in the laboratory centrifuge 5430 R from Eppendorf®, comprises a discus-like cover in which a groove that is open radially outwards is arranged, wherein the groove contains an O-ring as a sealing means. When being closed, the cover is inserted into a corresponding, approximately vertically extending recess in the lower part and is braced downwards, wherein the O-ring is clamped between the groove and the side wall of the lower part in order to bring about the sealing. By means of the aerosol-tight sealing, the centrifuge containers can be easily transported and manipulated without the risk that the samples may contaminate the centrifuge or the surrounded portions.

The closure between the cover and the lower part may be configured in various ways.

First of all, centrifuge rotors are known in which a locking nut is arranged on the cover so as to be freely rotatable and the lower part comprises a corresponding thread surrounded portion the hub. An example of such a centrifuge rotor is the model F-45-32-5-PCR from Eppendorf®. In order to close the cover against the lower part, the cover has to be placed onto and screwed to the thread by means of the locking nut. This requires two hands, namely one hand that holds the lower part and one hand that places on and tightens the locking nut. In addition, the locking nut must complete several revolutions until the closure is secure, which is associated with increased effort.

In order to reduce this effort, centrifuge rotors are already known in which a kind of bayonet catch is used such that only approximately half a revolution of a corresponding locking nut needs to be completed until the closure is secure. An example of such a centrifuge rotor is the model FA-45-18-11 from Eppendorf®. In this case, the closure is in the form of a transmission thread, the pitch angle of which is selected such that the locking nut with its locking cam is automatically rotated until just before the closure position due to the dead weight of the cover. In addition, by means of a rubber-elastic seal, positive locking is provided, as described in EP 2 024 097 A1. As a result, the cover only needs to be placed on with one hand, after which the locking nut automatically rotates until before the locking position. The locking nut then still only needs to be rotated further by a few degrees in order to carry out the locking, wherein the rubber-elastic seal brings about the locking together with an indentation in the bayonet-catch slot opposite the locking cam. However, two hands are still required for this last step.

SUMMARY

The object of the present invention is therefore to improve the centrifuge rotor in relation to the closure between the lower part of the centrifuge rotor and the cover such that a real single-handed operation is made possible. In particular, the closure is intended to be closed and detached again using just one hand. Preferably, the closure is intended to have a simpler structure and also to be produced more cost-effectively.

This object is achieved by the claimed centrifuge rotor according to claim 1. Advantageous developments are set out in the dependent claims and in the following description together with the drawings.

The inventor has identified that this problem can be solved particularly simply in a surprising manner if there is a lock in the form of a first undercut, in which a projection engages, between the cover and the lower part of the centrifuge rotor. The cover and the lower part therefore interlock in a detachable manner. As a result, the cover can be easily arranged on the lower part and removed therefrom again.

This projection can be removed from the first undercut to produce an open state. Here, the projection can be preloaded in order for it to be possible to easily produce the closed state by means of the lock.

The centrifuge rotor comprises a lower part and a cover, wherein the centrifuge rotor has a rotational axis, wherein the cover can be placed onto the lower part along the rotational axis in a closing direction and can be removed along the rotational axis in a detaching direction, wherein, when the cover is closed, there is a closure between the lower part and the cover, and it is characterized in that at least one of the elements out of the lower part and the cover comprises at least one first undercut, in which, when the cover is closed, at least one projection engages, which is arranged on the other of the elements out of the cover and the lower part.

In an advantageous development, it is provided that the first undercut is designed to extend perpendicularly to the rotational axis. As a result, the lock is also particularly secure during operation of the laboratory centrifuge.

In an advantageous development, it is provided that the first undercut is designed to extend all the way around the rotational axis. As a result, the cover may be arranged on the lower part in any azimuthal orientation in relation to the rotational axis of the centrifuge rotor.

In an advantageous development, it is provided that the projection has a chamfer or rounded portion that points towards the lower part and/or the first undercut has a chamfer or rounded portion that points towards the cover. As a result, the closing process is made easier.

In an advantageous development, it is provided that a closing aid is arranged which is preferably designed as a chamfer or rounded portion, by means of which the projection is brought into engagement with the first undercut when the cover is placed onto the lower part, wherein it is preferably provided that the projection has a chamfer or rounded portion that points towards the lower part and/or a chamfer or rounded portion that points towards the cover is arranged in front of the first undercut relative to the closing direction. As a result, the cover can be very easily locked to the lower part, meaning that the single-handed operation is improved.

In an advantageous development, it is provided that the chamfer has an angle in the range of from 20° to 80°, preferably 45° to 75°, in particular 60°, relative to the rotational axis. As a result, the closing aid is particularly effective.

In an advantageous development, it is provided that the projection has a chamfer or rounded portion that points towards the cover and/or the first undercut has a chamfer or rounded portion that points towards the lower part. As a result, the cover is pressed onto the lower part during centrifuging. This both reinforces the sealing between the cover and lower part and the cover is prevented from wobbling on the lower part.

In an advantageous development, it is provided that two opposing projections are formed in relation to the rotational axis. As a result, the closure is constructed symmetrically and therefore is particularly secure even at high speeds of the laboratory centrifuge. Three to five symmetrical projections can also be arranged, meaning that single-handed operation would still be possible. However, although the closure becomes more secure the more projections that are used, it is also becomes more unwieldy.

In an advantageous development, it is provided that the projection has a preloading that points towards the first undercut, which preloading is preferably provided by a spring (recoil spring), in particular by a molded spring. As a result, the lock can be particularly securely produced, such that the single-handed operation is improved.

In an advantageous development, it is provided that the projection is arranged on a lever having a fulcrum, wherein the fulcrum is preferably arranged on the cover. As a result, the projection can be actuated particularly easily.

In an advantageous development, it is provided that the center of mass of the lever is situated above the fulcrum in relation to the closing direction. As a result, there is a particularly secure lock even at high speeds of the centrifuge rotor, because the moments of inertia in conjunction with the centrifugal forces ensure that the projection does not come out of engagement with the first undercut. In addition, the pressure on an optionally present recoil spring is relieved as a result during centrifuging, which increases its service life.

In an advantageous development, it is provided that the lever, which is preferably an injection-molded part, comprises at least two lever parts. As a result, the lever can be produced with a very low weight, preferably so as to be hollow at least in part, meaning that the weight of the centrifuge rotor can be kept low. The lever parts can be injection molded. As an alternative to injection molding, milling or pressure die casting can also be used. It also does not necessarily have to be produced with a cavity.

In an advantageous development, it is provided that, when the cover is closed, the projection has at least one contact point with the first undercut, of which the radial spacing from the rotational axis corresponds at most to the radial spacing of the fulcrum of the lever from the rotational axis of the rotor. As a result, when pulling the cover away from the lower part and during centrifuging, no forces occur which could cause the lock between the cover and the lower part to open. Particularly preferably, the radial spacing between the contact point and the rotational axis is identical to the radial spacing of the fulcrum from the rotational axis. The contact point is then positioned vertically below the fulcrum. By means of this configuration, the lever arm becomes zero and no forces arise during centrifuging that would result in the lever opening. As a result, such a force also does not need to be compensated for by the spring or the centrifugal force during centrifuging. Such a defined contact point can, for example, be produced by the projection being slightly rounded in the region of the contact point.

In an advantageous development, it is provided that at least one side of the spring is anchored inside the lever. As a result, the spring is particularly securely mounted.

In an advantageous development, it is provided that the fulcrum comprises a bearing shaft, which is mounted in a blind hole on one side, wherein there are two levers and the corresponding blind holes are arranged rotationally symmetrically relative to the rotational axis. As a result, no imbalances can occur during operation. A through-hole for the bearing shaft is then preferably arranged on the other side.

In an advantageous development, it is provided that the cover comprises a circular cut-out for fastening the centrifuge rotor in a centrifuge, wherein the lever has a concave shaping which continues the circular cut-out and points towards the rotational axis, wherein the lever is preferably arranged such that, when the cover is closed, the concave shaping does not project inwards into the circular cut-out. As a result, the centrifuge rotor can be mounted in a centrifuge very easily and at the same time the locked state of the cover on the lower part is clearly indicated, such that operating errors are prevented. By continuing the concave shape of the cover and the lever, the closed state of the rotor cover can thus be clearly identified, since, if the cover is not properly closed, this visual continuation is not present, which can be easily visually noticed by the operator.

In an advantageous development, it is provided that the cover has a second undercut which acts as a handle for carrying the centrifuge rotor, wherein the second undercut preferably projects relative to the cover. As a result, the centrifuge rotor can be very comfortably handled without the risk of the lock between the cover and the lower part being detached during the support (handling). This is further improved by the levers projecting relative to the second undercut, meaning that they can be easily prevented from being actuated during the support. In an extreme case, the second undercut in the region of the levers can be omitted.

In an advantageous development, it is provided that there is a preferably aerosol-tight seal between the cover and the lower part after the first undercut in relation to the closing direction, such that the closure is arranged outside a sample space formed between the cover and the lower part in relation to the seal. This seal is preferably designed as a sealing element which is clamped between the cover and the lower part.

Independent protection is claimed for a centrifuging method which uses the centrifuge rotor.

BRIEF DESCRIPTION OF THE DRAWINGS

The features and further advantages of the present disclosure become apparent in the following with reference to the description of a preferred embodiment in conjunction with the drawings, in which, purely schematically.

DETAILED DESCRIPTION

Figure 1:
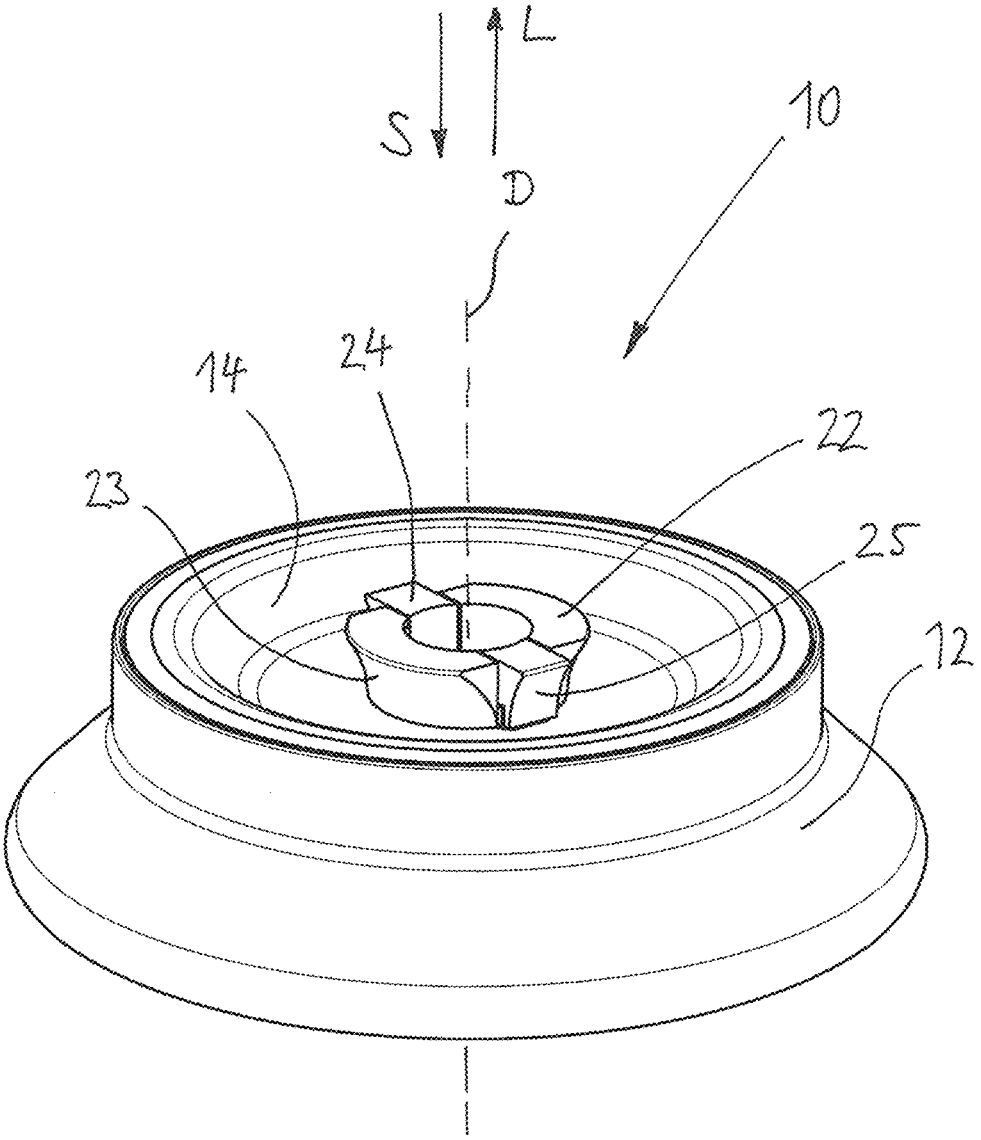
FIG. 1 is a perspective view of a centrifuge rotor according to a first preferred configuration.

FIGS. 1 to 8 are various views of the centrifuge rotor 10 and parts thereof.

It is clear that this centrifuge rotor 10 is rotationally symmetrical as far as possible and comprises a lower part 12 and a cover 14, wherein the cover 14 is placed onto the lower part 12 in a closing direction S that is parallel to the rotational axis D and can be removed in a detaching direction L that is parallel to the rotational axis D.

The lower part 12 comprises a series of evenly spaced holes or compartments 16 for receiving sample vessels in the form of test tubes, for example (not shown). A hub 18 comprising a hole 20 is arranged centrally in the lower part 12, which hole can receive a drive shaft of a laboratory centrifuge (neither are shown), by means of which the centrifuge rotor 10 can be driven. A carrying handle 22 comprising an undercut 23 provided for gripping is formed on the hub 18 so as to project from the cover 14, by means of which carrying handle the centrifuge rotor 10 can be gripped and handled without loosening the cover 14 as a result.

The cover 14 comprises two levers 24 that each have an undercut 25 provided for gripping, wherein the levers 24 are arranged so as to be opposite one another and with equal spacing in relation to the rotational axis D.

A sample space 26 is formed between the lower part 12 and the cover 14 and sealed in an aerosol-tight manner by the outer seal 28 and inner seal 30, which are arranged between the lower part 12 and the cover 14 and are each formed rotationally symmetrically relative to the rotational axis D. The compartments 16 and thus the individual sample vessels are accessible from this sample space 26.

Figure 3:
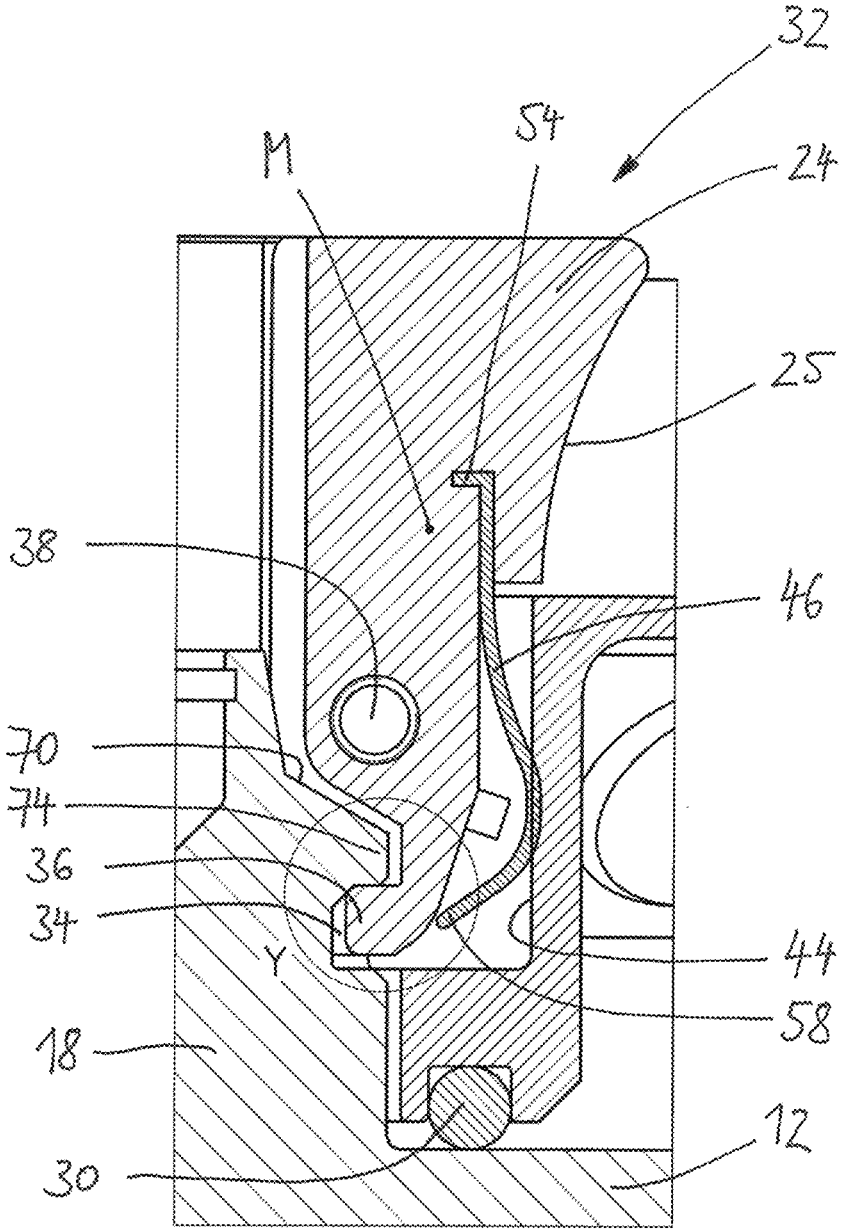
FIG. 3 is a sectional view of a detail of the closure of the centrifuge rotor according to FIG. 2.
Figure 4:
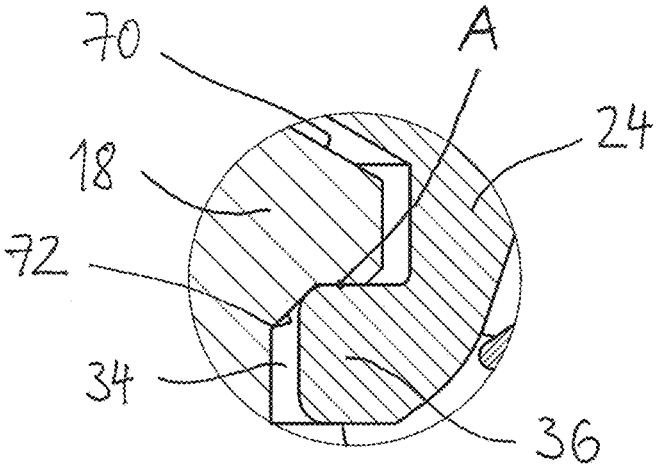
FIG. 4 is a sectional view of a detail of the region Y of the closure of the centrifuge rotor according to FIG. 3.

Furthermore, a closure 32 is formed between the lower part 12 and the cover 14, and is shown in views of details in FIGS. 3 and 4.

It is clear that the closure 32 is formed by the two levers 24 and an undercut 34, in which the respective projections 36 of the levers 24 engage.

Figure 5:
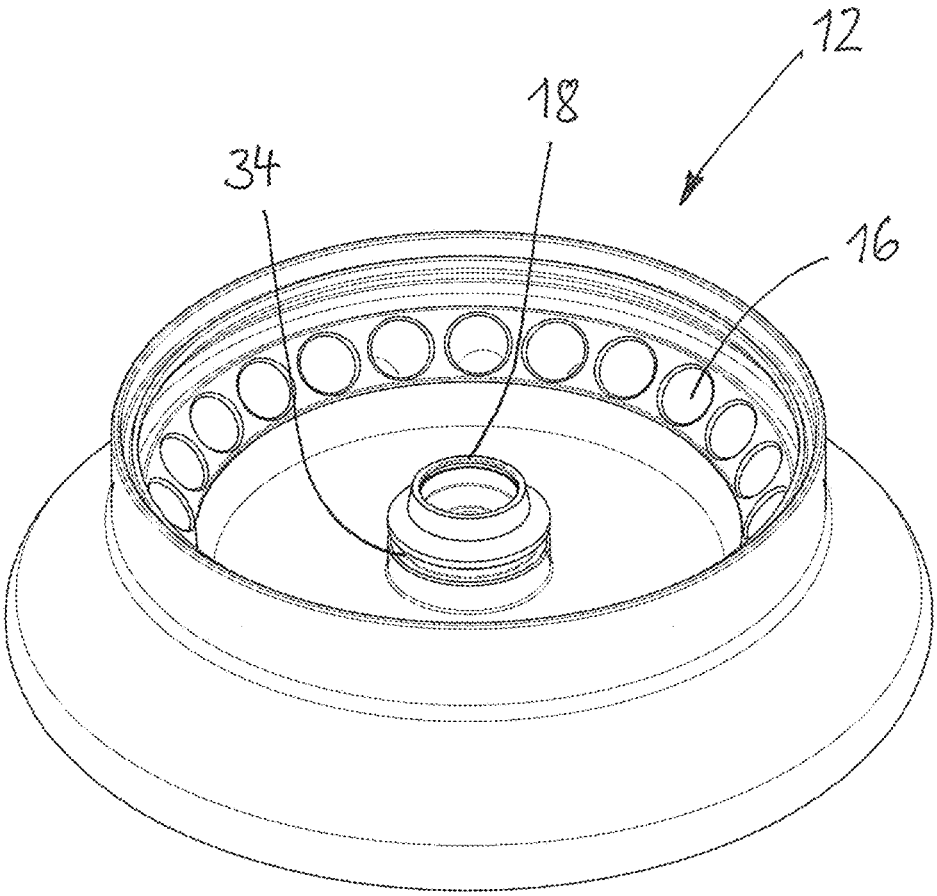
FIG. 5 shows the lower part of the centrifuge rotor according to FIG. 1.

As shown in FIG. 5, the undercut 34 is continuously formed in the circumferential direction, i.e. extends around the rotational axis D and is open in the radial direction. It is therefore a radially open circumferential groove 34.

The levers 24 are designed such the center of mass M thereof is situated above the bearing 38 in relation to the detaching direction L. In this case, the bearing is a bolt 38, which is screwed into the blind hole 40 by a thread, as can be seen from FIG. 6. This blind hole 40 is arranged in the carrying handle 22, and specifically so as to be opposite a through-hole 42, through which the bolt 38 can be screwed into the blind hole 40 by the lever 24. In this case, the blind holes 40 are arranged to be rotationally symmetrical.

To receive the levers 24, the cover 14 comprises a recess 44, in which the lever 24 is arranged so as to be able to tilt about the bolt 38. In this case, in relation to its projection 36, the lever 24 is preloaded against the undercut 34 by the molded spring 46, which is supported on the recess 44, as can be seen best in FIG. 3.

Figure 7:
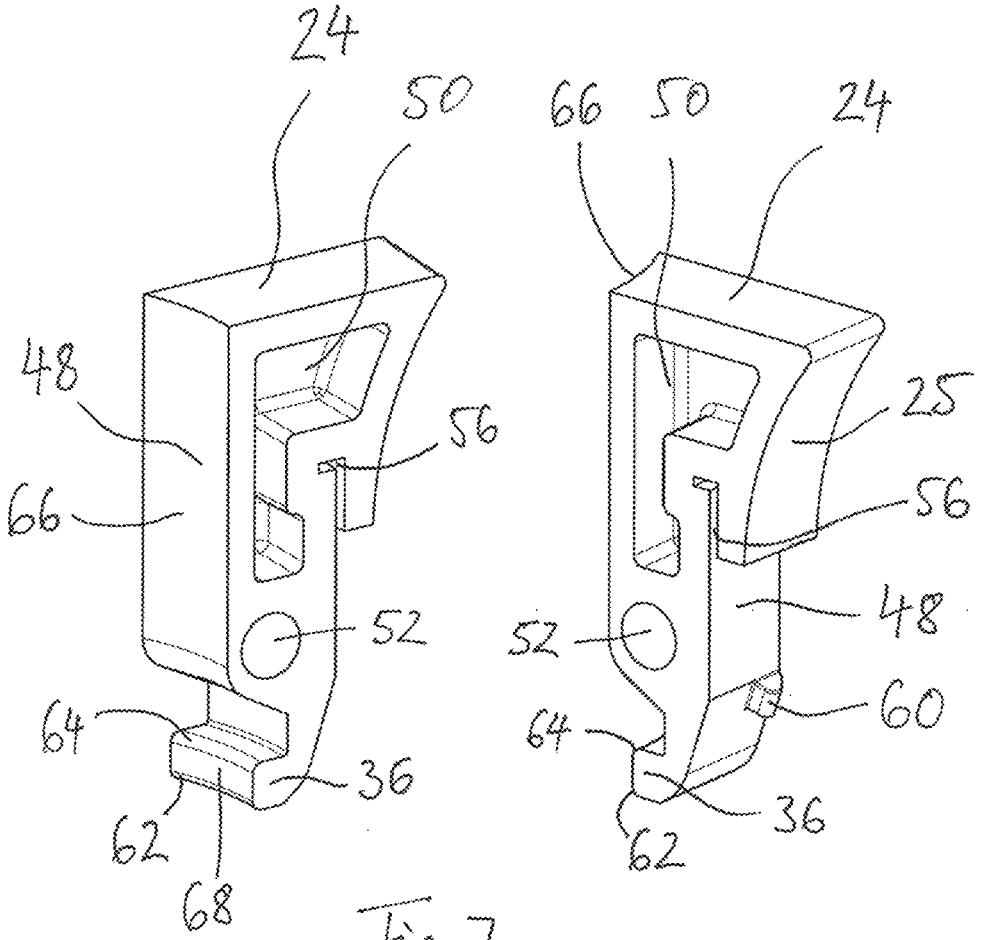
FIG. 7 shows two different views of a part of the lever of the centrifuge rotor according to FIG. 1.
Figure 8:
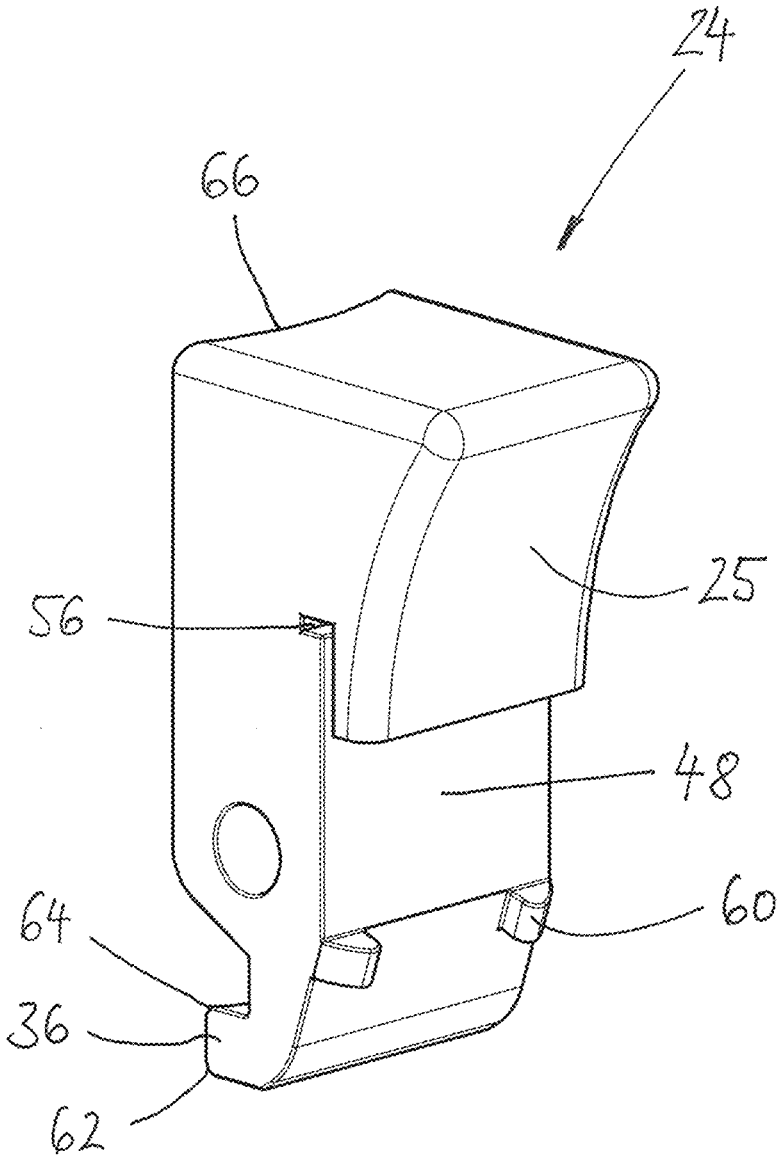
FIG. 8 is an overview of the lever of the centrifuge rotor according to FIG. 1.

As can be seen from FIGS. 7 and 8, the lever 24 is constructed from two injection-molded parts 48 (the connecting seam of the two injection-molded parts 48 is not shown in FIG. 8), wherein, in FIG. 7, only one half 48 is shown in each case in two different perspective views. Said levers are divided into two for manufacturing reasons, since this makes plastics injection molding possible for the levers 24. The levers 24 can thus be provided with a cavity 50 for weight reduction without preventing them from being demolded. As an alternative to the injection molding, milling or pressure die casting can also be used, for example. By contrast, the lever 24 can also be formed in one piece, without being divided into two.

Furthermore, the levers 24 comprise a through-hole 52 for the bolt 38. The molded spring 46 is mounted in a depression 56 by one end 54 thereof. The other end 58 is free, but is retained on either side by projections 60.

The projection 36 comprises a first chamfer 62 pointing in the direction of the lower part 12 and a second chamfer 64 pointing in the direction of the cover 14. In addition, FIG. 7 shows that the inner surfaces 66, 68 are grooved.

Figure 2:
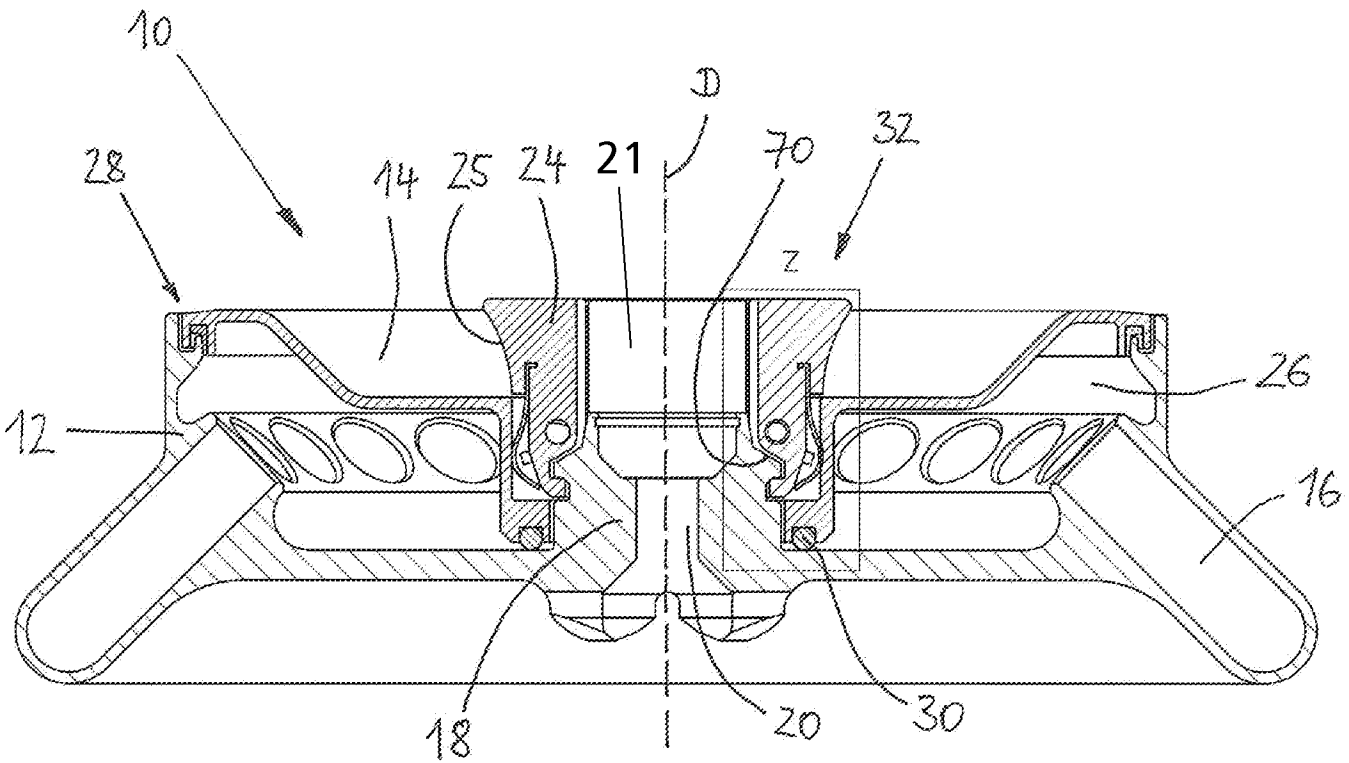
FIG. 2 is a sectional view of the centrifuge rotor according to FIG. 1.

FIGS. 2 and 4 show that a first chamfer 70 is formed on the lower part 12 in front of the undercut 34 in the closing direction and the undercut 34 comprises a second chamfer 72 pointing towards the lower part 12.

The first chamfer 62 of the projection 36 and the first chamfer 70 of the lower part arranged above the undercut 34 act as a closing aid, since, when pushing the cover 14 onto the lower part 12 in the closing direction S, the projection 36 is automatically guided radially outwards from the rotational axis D under the spring force of the spring 46 and the projection 74 on the lower part 12 is passed, and without the levers 24 needing to be actuated manually.

The cover 14 is pressed onto the lower part 12 by the second chamfer 64 on the projection 36 and the second chamfer 72 of the lower part 12 in the undercut 34 during operation of the centrifuge rotor 10. As a result, the pressure on the spring 46 is relieved, which increases its service life, and the cover 14 is also prevented from wobbling on the lower part 12.

FIGS. 3 and 4 also show that the contact point A between the projection 36 and the undercut 34 is situated closer to the rotational axis D in relation to the central point of the bearing 38. As a result, neither forces causing the cover 14 to become detached in the event of traction in the detaching direction L nor forces causing the closure 32 to become detached during operation of the centrifuge rotor 10 exert any action. As an alternative, it may also be provided that the radial spacing between the contact point A and the rotational axis D is identical to the radial spacing of the fulcrum of the bearing 38 from the rotational axis D. The contact point A is then positioned vertically below the fulcrum. By means of this configuration, the lever arm becomes zero and no forces arise during centrifuging that would result in the lever 24 opening. As a result, such a force also does not need to be compensated for by the spring 46 or the centrifugal force during centrifuging. Such a defined contact point A can, for example, be produced by the projection 36 being slightly rounded (not shown) in the region of the contact point A.

By forming the center of mass M above the bearing 38, during operation of the centrifuge rotor 10 the upper end of the lever 24 is pressed radially outwards, meaning that the lock between the projection 36 and the undercut 34 is reinforced. In addition, the pressure on the spring 46 is also relieved thereby.

Figure 6:
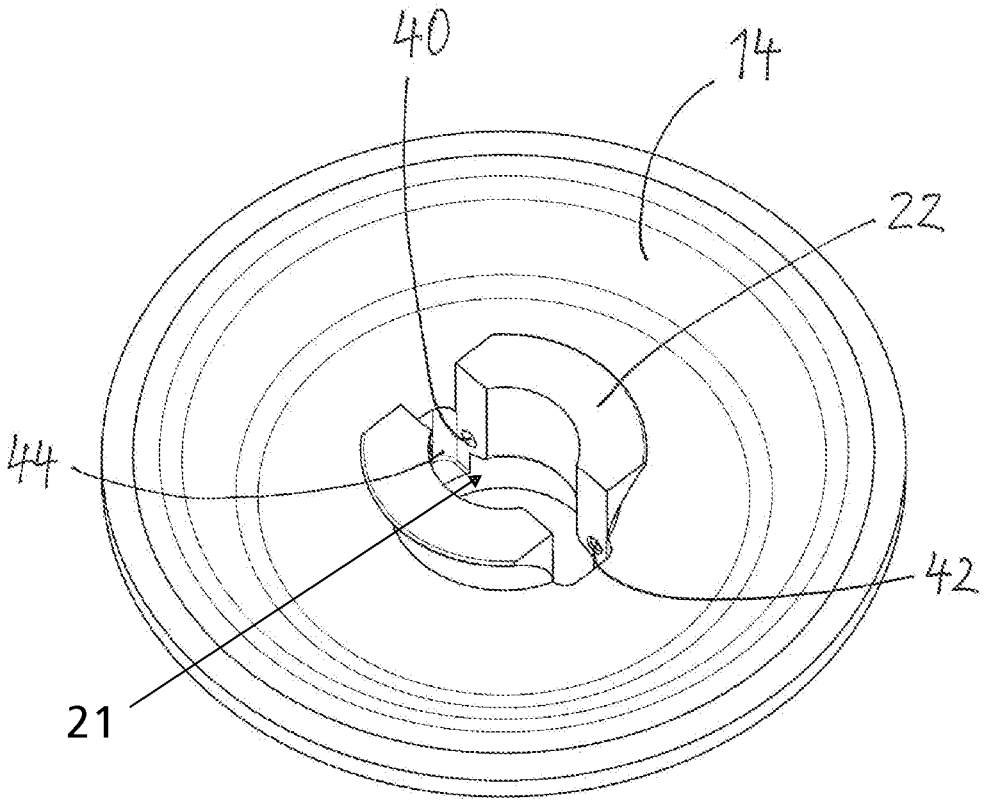
FIG. 6 shows a part of the cover of the centrifuge rotor according to FIG. 1.

FIG. 6 shows that the carrying handle 22 is formed around the recesses 44 without an undercut 25. As a result, in the locked state, the levers 24 project radially outwards relative to the handle 22 (cf. FIG. 1). As a result, proper locking is always reliably indicated.

By contrast, the concave radially inner surface 66 of each lever 24 is grooved and has the same radius as a hole or circular cut-out 21 located in the cover and in the region of the handle 22. As a result, fastening means for connecting the centrifuge rotor 10 to the shaft of a centrifuge motor (not shown) can be easily actuated. In addition, on account of the continuation of the concave groove of the inner surface 66 of the lever 24 and the hole or circular cut-out 21, the properly locked state can likewise be clearly identified by the hole or circular cut-out 21 and the grooved inner surfaces 66 of the levers 24 forming a continuous circular surface (cf. FIG. 1), i.e. the user can identify an improperly locked state by the concave shape not being continued but there instead being a stepped offset or discontinuity, which is very easily perceptible to the user's eye.

In the locked state of the cover 14, the sample space 26 is formed on the lower part 12 in a completely aerosol-tight manner by means of the seals 28 and 30, since the closure 32 is situated outside the sample space 26.

It has become clear from the information set out that the present disclosure provides a centrifuge rotor 10 in which the closure 32 between the lower part 12 of the centrifuge rotor 10 and the cover 14 has been improved such that proper single-handed operation is made possible. In particular, the closure 32 can be closed and detached again using just one hand. This means that the closure 32 has a simpler structure and can also be produced more cost-effectively.

Unless otherwise stated, all the features of the present disclosure can be freely combined with one another. Unless otherwise stated, the features described in the description of the figures can also be freely combined with the remaining features as features of the disclosure. Claimed features of the apparatus can also be reworded into method features as part of a method and method features can also be reworded into features of the centrifuge rotor as part of the centrifuge rotor. A centrifuging method which uses the centrifuge rotor is therefore expressly intended to be protected.

LIST OF REFERENCE SIGNS

- 10 first preferred configuration of the centrifuge rotor according to the invention
- 12 lower part
- 14 cover
- 16 holes or compartments for receiving sample vessels
- 18 hub
- 20 hole in hub 18
- 22 carrying handle
- 23 undercut for gripping the carrying handle 22, second undercut
- 24 actuation lever
- 25 undercut for gripping the actuation lever 24
- 26 sample space
- 28 outer seal between lower part 12 and cover 14
- 30 inner seal between lower part 12 and cover 14
- 32 closure between lower part 12 and cover 14
- 34 undercut in lower part 12, circumferential groove, first undercut
- 36 projections of the actuation lever 24
- 38 bearing shaft, bolt 38
- 40 blind hole
- 42 through-hole
- 44 recess in the cover 14
- 46 recoil spring, molded spring
- 48 an injection-molded part of the actuation lever 24
- 50 cavity in actuation lever 24
- 52 through-hole in actuation lever 24
- 54 one end of the spring 46
- 56 depression in actuation lever 24 for spring 46
- 58 other end of the spring 46
- 60 projections
- 62 first chamfer of the projection 36, closing aid
- 64 second chamfer of the projection 36
- 66, 68 inner surfaces of the lever 24
- 70 first chamfer on the lower part 12, closing aid
- 72 second chamfer on the lower part 12
- 74 projection on the lower part 12

D rotational axis D
L detaching direction
M center of mass
S closing direction

The invention claimed is:

1. A centrifuge rotor (10), comprising:
a lower part (12); and
a cover (14),
wherein the centrifuge rotor (10) has a rotational axis (D),
wherein the cover (14) can be placed onto the lower part (12) along the rotational axis (D) in a closing direction (S) and can be removed along the rotational axis (D) in a detaching direction (L),
wherein, when the cover (14) is closed, there is a closure (32) between the lower part (12) and the cover (14), and
wherein at least one element selected from the group consisting of the lower part (12) and the cover (14) comprises at least one first undercut (34), in which, when the cover (14) is closed, at least one projection (36) engages, which is arranged on another element from the group consisting of the cover (14) and the lower part (12),
wherein the projection (36) is arranged on a lever (24) having a fulcrum (38), and wherein the fulcrum (38) is arranged on the cover (14)
wherein the cover (14) comprises a circular cut-out for fastening the centrifuge rotor (10) in a centrifuge,
wherein the lever (24) has a concave shaping (66) which continues the circular cut-out and points towards the rotational axis (D), and
wherein the lever (24) is arranged such that, when the cover (14) is closed, the concave shaping (66) does not project inwards into the circular cut-out.

2. The centrifuge rotor (10) according to claim 1,
wherein the first undercut (34) extends perpendicularly to the rotational axis (D), and/or
wherein the first undercut (34) extends all the way around the rotational axis (D).

3. The centrifuge rotor (10) according to claim 1,
wherein a closing aid is arranged which is designed as a chamfer (62, 70) or rounded portion, by which the projection (36) is brought into engagement with the first undercut (34) when the cover (14) is placed onto the lower part (12),
wherein the projection (36) has a chamfer (62) or rounded portion that points towards the lower part (12) and/or
wherein a chamfer (70) or rounded portion that points towards the cover (14) is arranged in front of the first undercut (34) relative to the closing direction (S).

4. The centrifuge rotor (10) according to claim 3,
wherein the chamfer (62, 70) has an angle in a range of 20° to 80° relative to the rotational axis (D).

5. The centrifuge rotor (10) according to claim 1,
wherein the projection (36) has a chamfer (64) or rounded portion that points towards the cover (14) and/or the first undercut (34) has a chamfer (72) or rounded portion that points towards the lower part (12).

6. The centrifuge rotor (10) according to claim 1,
wherein two opposing projections (36) are formed in relation to the rotational axis (D).

7. The centrifuge rotor (10) according to claim 1,
wherein the projection (36) has a preloading that points towards the first undercut (34), which preloading is provided by a molded spring (46).

8. The centrifuge rotor (10) according to claim 1,
wherein a center of mass (M) of the lever (24) is situated above the fulcrum (38) in relation to the closing direction (S).

9. The centrifuge rotor (10) according to claim 1,
wherein the lever (24) comprises two lever parts (48).

10. The centrifuge rotor (10) according to claim 1,
wherein, when the cover (14) is closed, the projection (36) has at least one contact point (A) with the first undercut (34), of which a radial spacing from the rotational axis (D) corresponds at most to a radial spacing of the fulcrum (38) from the rotational axis (D), and
wherein the radial spacing of the contact point (A) from the rotational axis (D) is identical to the radial spacing of the fulcrum (38) from the rotational axis (D).

11. The centrifuge rotor (10) according to claim 1,
wherein the projection (36) has a preloading that points towards the first undercut (34), which preloading is provided by a molded spring (46), and
wherein at least one side (54) of the spring (46) is anchored inside the lever (24).

12. The centrifuge rotor (10) according to claim 1,
wherein the fulcrum comprises a bearing shaft (38), which is mounted in a blind hole (40) on one side, and
wherein there are two levers (24) and the corresponding blind holes (40) are arranged rotationally symmetrically relative to the rotational axis (D).

13. The centrifuge rotor (10) according to claim 1,
wherein the cover (14) comprises a second undercut (23) as a handle for carrying the centrifuge rotor, and
wherein the second undercut (23) projects relative to the cover (14).

14. The centrifuge rotor (10) according to claim 1,
wherein there is a aerosol-tight seal (30) between the cover (14) and the lower part (12) after the first undercut (34) in relation to the closing direction (S), such that the closure (32) is arranged outside a sample space (26) formed between the cover (14) and the lower part (12) in relation to the seal (30).

* * * * *